United States Patent [19]

Hallam

[11] 4,227,352

[45] Oct. 14, 1980

[54] ROOF GUTTER

[75] Inventor: Dennis M. Hallam, Zillmere, Australia

[73] Assignee: E. Sachs & Co. Ltd., Zillmere, Australia

[21] Appl. No.: 4,524

[22] Filed: Jan. 18, 1979

[30] Foreign Application Priority Data

Jan. 19, 1978 [AU] Australia ..... PD3080

[51] Int. Cl.[3] ..... E04D 13/04

[52] U.S. Cl. ..... 52/11; 52/94

[58] Field of Search ..... 52/11, 12, 15, 16, 94, 52/95; 248/48.1, 48.2

[56] References Cited

U.S. PATENT DOCUMENTS

| | | | |
|---|---|---|---|
| 317,841 | 5/1885 | Newton | 52/11 |
| 3,080,682 | 3/1963 | Teutsch | 52/12 |
| 3,913,284 | 10/1975 | Hall | 52/11 |
| 4,128,974 | 12/1978 | Taylor | 52/11 |

FOREIGN PATENT DOCUMENTS

| | | | |
|---|---|---|---|
| 272934 | 2/1967 | Australia | 52/11 |
| 296054 | 4/1967 | Australia | 248/48.2 |
| 485268 | 5/1975 | Australia | 248/48.2 |
| 1370694 | 7/1964 | France | 52/11 |
| 2275608 | 1/1976 | France | 52/94 |

*Primary Examiner*—Alfred C. Perham

*Attorney, Agent, or Firm*—Schwartz, Jeffery, Schwaab, Mack, Blumenthal & Koch

[57] ABSTRACT

A roof gutter of channel form, with a bottom and upright front and rear flanges, is supported by a series of brackets secured to a roof structure, each bracket having a top arm which is engaged with the front flange of the gutter to prevent its being raised or lowered, the rear bottom part of the gutter being snapped into engagement with the bracket to secure the gutter in place.

2 Claims, 3 Drawing Figures

FIG. 2.
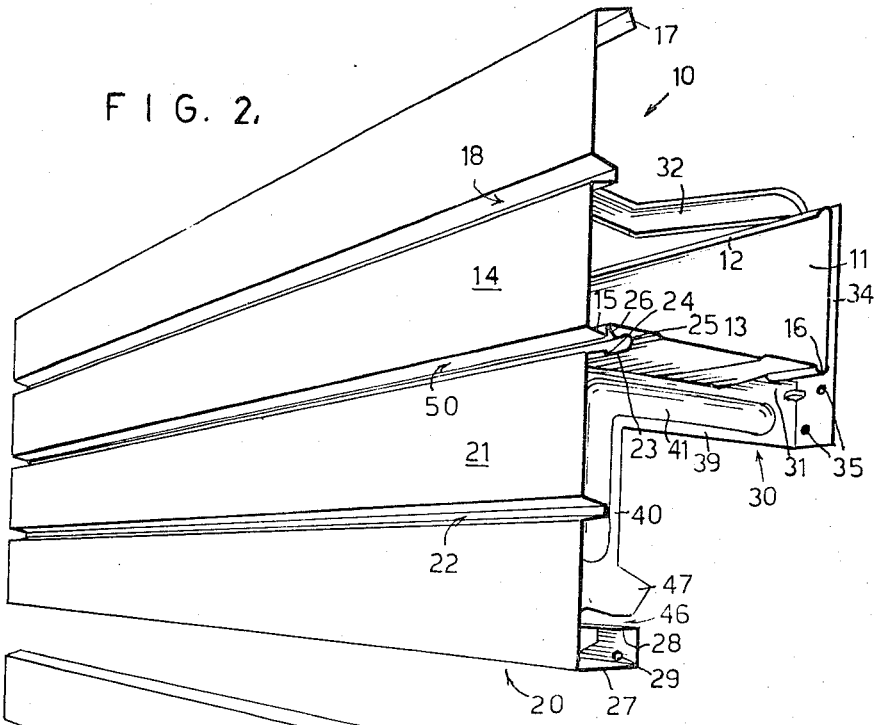
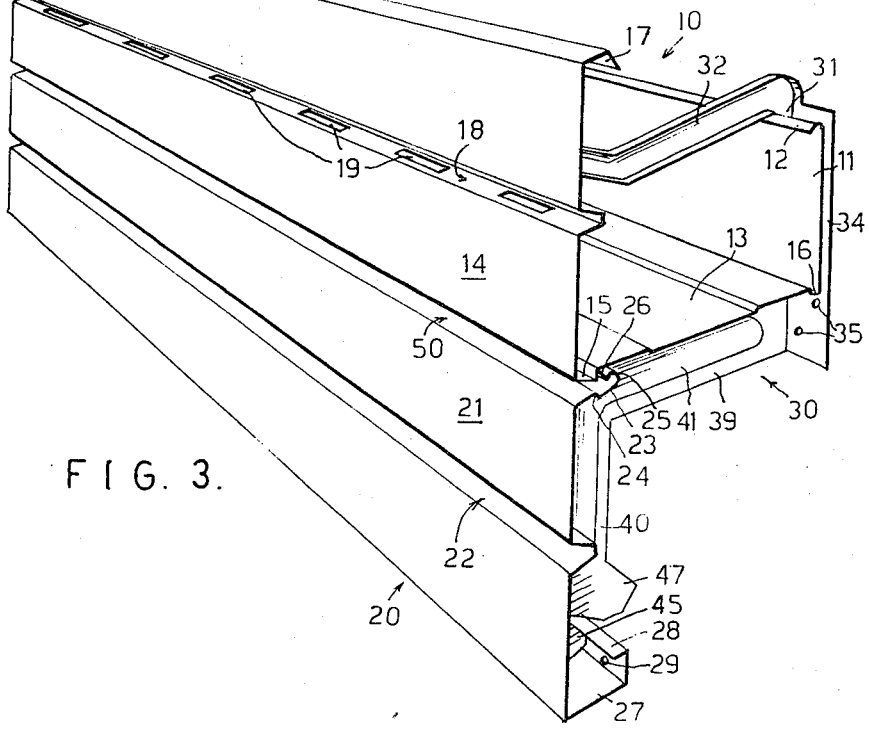
FIG. 3.

ROOF GUTTER

BACKGROUND OF THE INVENTION

This invention relates to a roof gutter.

A gutter installed on a house or other building to receive water from the roof and conduct it to downpipes is commonly of channelled form, secured by gutter brackets in front of the upper part of a fascia board, the roof tiles or other roofing members projecting over the top of the fascia board and the rear flange of the gutter, the front of the gutter being higher than the rear to prevent driven rain from entering under the roof.

The gutter brackets used vary considerably in design, but all such brackets known to us include deformable parts which are bent to engage with and hold the gutters. This involves a good deal of time and labour.

BRIEF SUMMARY OF THE INVENTION

The present invention has for its main object the provision of a guttering system by the use of which a gutter may be quickly and easily installed on a roof structure. Other objects achievable in preferred embodiments of the invention are to provide a gutter assembly which is simple and economical to manufacture, which is particularly neat and attractive in appearance, and which will enable considerable economies to be effected in the construction of a roof structure to which the assembly is applied.

With the foregoing and other objects in view, the invention resides broadly in a roof gutter assembly of the type including a channel-shaped gutter with a bottom, and front and rear flanges, supported by engagement with gutter brackets attachable to a roof structure, wherein the gutter and each gutter bracket are provided with complementary locking means adapted, when the gutter is moved into a fully engaged position relative to the bracket, for automatic resilient interengagement to restrain the gutter against detachment from the gutter bracket. The bracket preferably has a back member with means whereby it may be secured to the roof structure, and an upper arm adapted to engage with, and prevent upward or downward movement of, the gutter's front flange, and the locking means preferably include a locking bead at the rear of the bottom of the gutter and a recess on the back member of the bracket. The bracket preferably is made with a lower arm extending under the gutter and with which a fascia panel is adapted to be clipped into engagement so that the fascia panel is below and substantially co-planar with the gutter's front flange. Other features of the invention will become apparent from the following description.

BRIEF DESCRIPTION OF THE DRAWINGS

A preferred embodiment of the invention is shown in the accompanying drawings, wherein:

FIG. 2 is a perspective view of the gutter assembly viewed from a low level, and FIG. 3 is a perspective view of the gutter assembly viewed from above.

Figure 1:
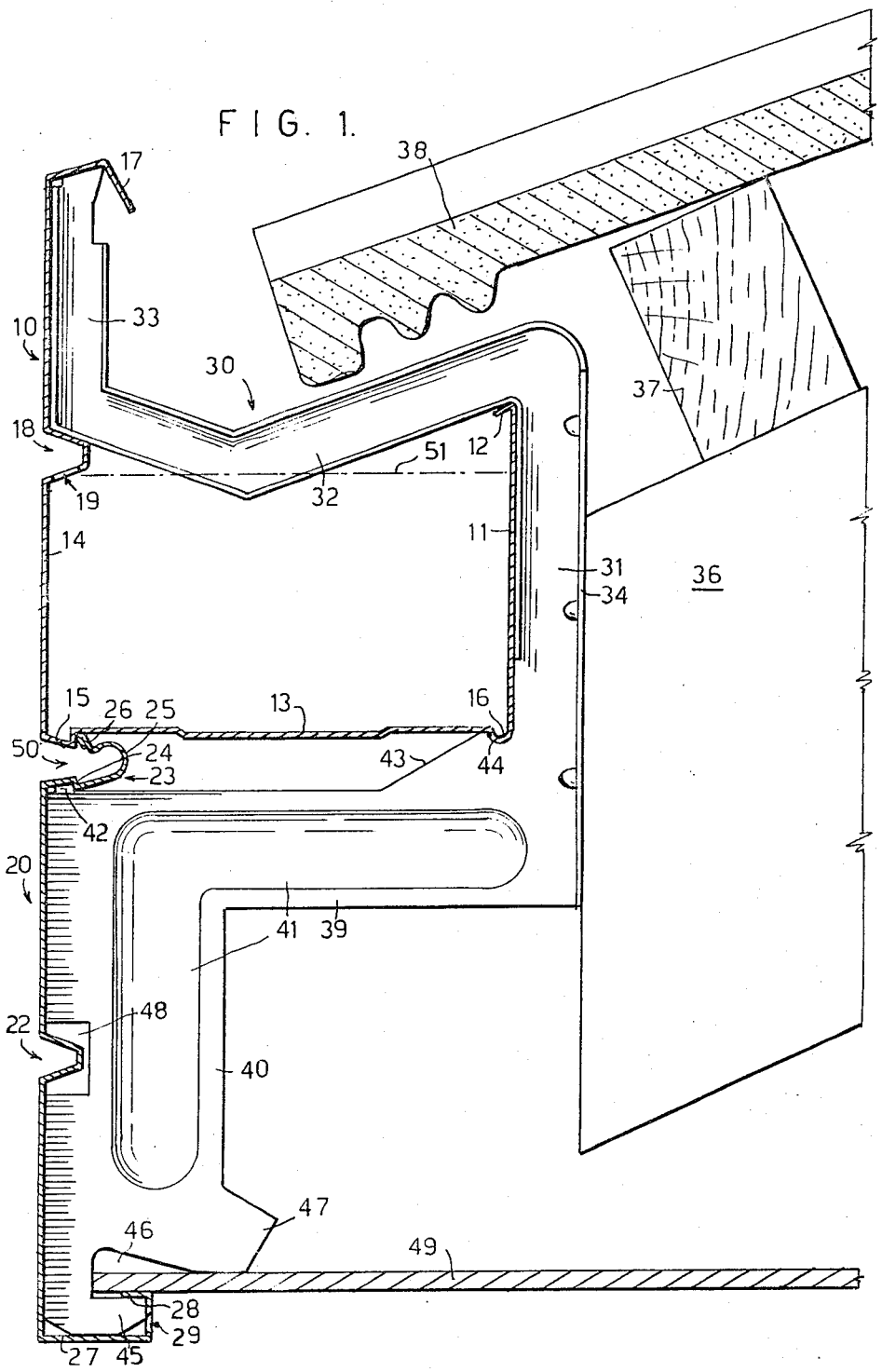
FIG. 1 is a cross-sectional view of a gutter assembly according to the invention, and part of a roof structure to which it is applied.

The assembly illustrated includes a gutter 10 of sheet metal, shaped to form a channel having a rear flange 11 with a top return flange 12, a bottom section 13 and a front flange 14 of considerably greater height than the rear flange.

The bottom section 13 is shaped to form an angular bottom front bead 15 adjacent to the front flange, 14 and an arcuately curved locking bead 16 adjacent to the rear flange 11.

The front flange 14 has its upper part bent along parallel lines through two acute angles to form a hooked support flange 17. About midway between its top and bottom, the front flange 14 is formed with a fairly deep continuous longitudinal groove or concavity 18, of which the top and bottom faces are rearwardly convergent. In the bottom face or upwardly-facing surface of this groove 18 there are formed overflow ports 19, being a longitudinal series of equally spaced fairly large slotted holes, which are some distance below the level of the top of the rear flange 11 of the gutter.

The assembly also includes a fascia panel 20 of sheet metal having a front face 21 of approximately the same depth as the front flange 14 of the gutter, and with a continuous longitudinal groove or concavity 22 midway between its top and bottom, and of similar profile to the groove 18 of the gutter.

The top of the fascia panel is shaped to form a locking strip 23. From the top of the front face 21, this strip inclines upwardly towards the rear, has a downwardly stepped formation at 24, then continues its upward and rearward inclination for some distance before curving upwardly and forwardly at 25, terminating in an upwardly and forwardly inclined flashing strip 26.

The bottom of the fascia channel is shaped to form a rearwardly extending bottom channel 27, the rear flange of which is bent forward at the top to constitute a soffit support flange 28. At intervals, small drainage holes 29 are formed in the rear flange of the bottom channel 27.

Both the gutter 10 and the fascia panel 20 are fixed on a series of mounting brackets 30 of pressed sheet metal. Each bracket has an upright back member 31 from the top of which an upper arm 32 extends forwardly, inclining downwardly for some distance and then inclining upwardly towards its front, from which there extends an integral top front upright 33. To impart rigidity, the upper arm 32 and most of the top front upright 33 and of the back member 31 are pressed to channel form, the rear flange of the channelled back member 31 being extended to constitute an attachment plate 34 with nail holes 35 (some of which are shown in FIGS. 2 and 3) to enable the bracket 30 to be nailed directly to the vertical end of a rafter 36 of a roof structure, which does not include the fascia board customarily provided. Battens 37 nailed onto the rafters 36 support roofing tiles 38.

From the bottom of the back member 31 of each bracket 30 a lower arm 39 extends forwardly, a bottom front upright 40 extending downwardly from its front end, an angled reinforcing rib 41 being pressed from the lower arm and bottom front upright to impart rigidity.

The top of the lower arm 39 has, at the front, an upwardly extending retaining lug 42, and towards the back, an upwardly inclining ramp 43 leading to a downwardly extending locking notch 44 next to the back piece 31 of the bracket.

The bottom front upright 40 has a rearwardly extending bottom lug 45, above which is a notch or recess 46, and above this recess is a rearwardly projection 47. A notch 48 is formed from the middle of the front of the bottom front upright 40.

The fascia panel is fitted by engaging its bottom channel 27 and flange 28 with the bottom lugs 45 of the brackets, and pressing the fascia panel back so the step 24 of locking strip 23 snaps into engagement with the bracket retaining lugs 42. Next the gutter is installed, hooking its support flange 17 on the front uprights 33 and pressing it back so its locking bead 16 rides up the ramps 43 of the brackets and into the locking notches 44, the fascia panel flashing strip 26 then bearing against the gutter's bottom front bead 15 to exclude moisture from the junction of gutter and fascia panel. The gutter cannot lift as its return flange 12 and recessed part 18 are then located close under the upper arms 32 of the brackets.

A soffit 49 of sheet material is supported at its front on the soffit flange 28 of the fascia panel, and is held down by the projections 47 of the brackets 30.

The gutter's bottom front bead 15 and the fascia panel's locking strip 23 define a continuous longitudinal recess 50 which, when the gutter is viewed from below, is of similar appearance to, and midway between, the longitudinal grooves or recesses 18 and 22 of the gutter and fascia panel. The co-planar gutter front flange 14 and fascia panel front face 21 therefore constitute a fairly deep unitary fascia with three equally spaced and similar horizontal grooves 18, 50 and 22, the overflow ports 19 in the upwardly-facing bottom surface of the top groove 18 not being visible from normal viewpoint. However, if the gutter 10 should become filled to the level indicated at 51 in FIG. 1, water will escape through the overflow ports and will not overflow the back flange 11 of the gutter, the top of which is at a considerably higher level. The junction of the gutter and the fascia panel is such that there will be very little likelihood of driven rain entering, but any moisture which may enter, or form by condensation, behind the fascia panel will be received in the bottom channel 27 and escape through the drainage holes 29.

The assembly may be installed quickly and easily and without any high degree of skill being required. The elimination of the customary fascia board will result in considerable economies in the construction of the building.

Moreover, as will be apparent from the drawings, and particularly FIG. 1, the gutter may be provided in usual manner with downpipes, not shown in the drawings, which, leading down and rearwardly from the gutter to the wall of the building, are concealed behind the fascia panel 20 and above the soffit 49, and therefore will be very unobstrusive and not detract from the appearance of the building.

I claim:

1. A roof gutter assembly comprising:

(a) a series of mounting brackets adapted to be secured to a roof assembly, each of said brackets being integrally formed and including a back member engaging said roof assembly, an upper arm extending forwardly from said back member, and a vertically extending front upright member, said back member forming an acute angle with said upper arm and being formed with a locking notch at its lower end, and (b) a channel-shaped gutter having substantially vertical front and back flanges, and a bottom wall interconnecting said flanges, said front flange including a hooked support flange at its upper end which extend rearwardly over said front upright member, a longitudinal groove formed in said front flange approximately intermediate the height thereof, said groove having rearwardly convergent top and bottom faces, said bottom face being below the top of the back flange of said gutter and having overflow ports formed therein, a locking bead formed at the juncture of said back flange and said bottom wall and engaging said locking notch of said back member of said bracket when said gutter is installed, said back flange of said gutter having a top return flange which is tightly positioned in the acute angle juncture of said back member and upper arm of said mounting bracket whereby said gutter is supported against movement on said bracket at at least three locations.

2. The roof gutter assembly of claim 1, wherein said upper arm of each of said mounting brackets is inclined upwardly at its forward end, with the rearwardly convergent top face of said longitudinal groove of said gutter tightly engaging the bottom surface of said forward end of said arm when said gutter is installed on said brackets, whereby the upper portion of said front flange of said gutter is restrained against vertically upward or downward movement.

* * * * *